US006170910B1

(12) United States Patent
Bapst

(10) Patent No.: US 6,170,910 B1
(45) Date of Patent: Jan. 9, 2001

(54) CHILD SUPPORT WITH CANOPY PIVOT AND METHOD OF USE

(75) Inventor: David M. Bapst, South Wales, NY (US)

(73) Assignee: Mattel, Inc., El Segundo, CA (US)

( * ) Notice: Under 35 U.S.C. 154(b), the term of this patent shall be extended for 0 days.

(21) Appl. No.: 09/123,354

(22) Filed: Jul. 28, 1998

(51) Int. Cl.[7] ..... A47C 7/62

(52) U.S. Cl. ..... 297/184.13; 297/183.2; 297/183.4; 16/377

(58) Field of Search ..... 297/183.2, 183.3, 297/183.4, 184.13, 184.15, 184.17, 377; 6/334, 337

(56) References Cited

U.S. PATENT DOCUMENTS

| | | | | |
|---|---|---|---|---|
| 601,613 | | 3/1898 | Castle . | |
| 610,352 | | 9/1898 | Grady . | |
| 1,140,020 | | 5/1915 | Bradley . | |
| 1,165,518 | * | 12/1915 | Krell | 16/334 |
| 1,429,881 | * | 9/1922 | Howe | 16/334 |
| 1,649,951 | | 11/1927 | English . | |
| 1,666,899 | * | 4/1928 | Henricson | 16/334 X |
| 2,525,658 | | 10/1950 | Dumelin | 128/80 |
| 2,922,669 | | 1/1960 | Hansen | 287/14 |
| 3,419,295 | | 12/1968 | Small | 287/99 |
| 3,586,355 | | 6/1971 | Magi | 287/14 |
| 3,875,610 | | 4/1975 | Wubbe et al. | 15/250.35 |
| 3,922,481 | | 11/1975 | Lewis | 174/146 |
| 4,620,813 | | 11/1986 | Lacher | 403/93 |
| 4,810,030 | | 3/1989 | Lewis | 297/184 |
| 4,832,299 | | 5/1989 | Gorton et al. | 248/231.7 |
| 4,883,315 | * | 11/1989 | Ferguson | 297/184.13 X |
| 4,978,166 | | 12/1990 | James | 297/184 |
| 5,069,474 | * | 12/1991 | Tai | 297/354.12 X |
| 5,190,390 | | 3/1993 | Ming-Tai | 403/24 |
| 5,207,755 | | 5/1993 | Ampian | 15/230.11 |
| 5,322,343 | | 6/1994 | Parker et al. | 297/183 |
| 5,522,639 | * | 6/1996 | Jaime | 297/184.13 |
| 5,542,151 | | 8/1996 | Stranski et al. | 16/326 |
| 5,551,745 | * | 9/1996 | Huang | 297/184.17 X |
| 5,765,856 | | 6/1998 | Kiser | 280/642 |
| 5,765,958 | | 6/1998 | Lan | 403/97 |
| 5,845,666 | * | 12/1998 | Messner | 16/334 X |
| 5,887,935 | | 3/1999 | Sack | 296/122 |

* cited by examiner

*Primary Examiner*—Peter R. Brown
(74) *Attorney, Agent, or Firm*—Morgan, Lewis & Bockius LLP

(57) ABSTRACT

The invention includes a pivot that is preferably attached to a child's seat and used to adjust the position of a canopy. The canopy pivot can be adjusted by pulling on the canopy frame to move the canopy to a desired position. No separate locking mechanisms are required for locking and unlocking the canopy at a plurality of different positions. The canopy pivot includes a flange member extending from the child's seat. The flange can have indents or nubs therein which mate with indents or nubs located on the canopy pivot member. The resiliency of the flange member at a specific location between the indents or nubs and the contact point of a retainer structure provides the necessary locking force for keeping the canopy pivot locked and for allowing it to unlock when a person pulls the canopy frame to pivot the canopy about the canopy pivot.

28 Claims, 16 Drawing Sheets

CHILD SUPPORT WITH CANOPY PIVOT AND METHOD OF USE

BACKGROUND OF THE INVENTION

1. Field of the Invention

This invention relates to a pivot for pivotally supporting a structure over a child support or other support device. More particularly, the invention relates to a canopy pivot that is easily attached to a child's seat and rotates with respect thereto to provide adjustability for an attached canopy. In addition, the invention relates to a canopy pivot that is automatically lockable at a plurality of positions with respect to a child seat such that a canopy can be quickly and easily positioned relative to the child seat.

2. Description of Related Art

Adjustable canopies are available for a variety of support structures, including vehicles, chairs, strollers, baby carriers, child car seats and other child supports. The use of an adjustable canopy in children's support structures is particularly popular for the purpose of protecting an infant or child from different elements, including sun rays, wind and rain.

Typically, an adjustable canopy that is attached to a support structure includes a complicated mechanism for pivoting the canopy relative to the support structure. For example, U.S. Pat. No. 4,978,166 to James discloses a sunshade for a child's car seat that includes a locking pivot for adjusting the canopy. A screw 70 and cap 74 must be loosened so that each of the ribs 32, 34 and 36 can be adjusted with respect to each other and the car seat. To lock the ribs 32, 34 and 36 in position with respect to each other and the car seat, screw 70 and cap 74 must be manually turned and tightened while each of the ribs are held in position.

Another type of adjustable pivot is disclosed in U.S. Pat. No. 5,765,958 to Lan. The Lan device has a toothed wheel (retaining member 5) that floats in a first structure (stationary seat member 31) and second structure (pivotable seat member 4) to lock the first and second structures together when the toothed wheel is in a first position. The second structure can be pivoted relative to the first structure when the toothed wheel is pushed against the force of a return spring and out of contact with the second structure. Once the second structure is in a desired position, the toothed wheel is released to allow the return force of the return spring to reposition the toothed wheel into mating relationship with the second structure, thus locking the first and second structures in place. The Lan device is complicated to manufacture and assemble and requires a separate manual lock/unlock step for operating the pivot.

Attempts have been made to avoid the step of manually unlocking and locking a canopy or other structure in position relative to a support device. For example, two different inventions use cylindrical ratchet members to automatically lock and unlock a canopy pivot without requiring a separate step of loosening, retracting or unlocking the canopy pivot. In the first invention, U.S. Pat. No. 5,551,745 to Huang discloses an adjustable device for a hood of a toy stroller. The adjustable device includes a first side element 40 and a second side element 40'. Sandwiched in between the first and second side elements is a middle element 50 that is configured as a wheel having two cylindrical toothed portions divided by a plate portion 52. A toothed periphery 531 on each cylindrical portion mates with protrusions 43 and 43' located in the first and second side elements, respectively. When support element 20 is rotated about the adjustable device, protrusion 43' rides over the toothed portion 531 of the middle element 50. Protrusions 43' will lock into one of the spaces between the teeth of the toothed portion 531 to lock the support 20 in position with respect to the stroller when rotation of the support 20 is stopped. Support 10 can be similarly and separately moved and locked in position by the corresponding toothed surface 531 and protrusions 43.

The Huang device suffers from the drawback that the support members 10 and 20 must be made of relatively rigid material, for example metal, so that a requisite amount of force can be applied to unlock the adjustable device and rotate the support about the adjustable device. In addition, the adjustable device requires a plurality of separate structures and is fairly complicated to manufacture. The device is also susceptible to wear and tear since the teeth elements must flex for rotation to take place. Finally, smooth rotation of the support members does not occur because the mating toothed surfaces require the support member to vibrate and move back and forth in radial directions as the support member rotates about the adjustable device.

Similarly, U.S. Pat. No. 5,322,343 to Parker et al. discloses an adjustable canopy that includes a canopy stay 74 having a plurality of detents 78 therein that mate with a plurality of tangs 82 formed on a cylindrical protrusion from the car seat shell. The Parker device is simpler than that disclosed in Huang but suffers from many of the same drawbacks. Moreover, because the stay 74 must ride over each of the extending tangs 82, the radial motion of the stay 74 is not smooth when the position of the canopy is being changed. In addition, a high level of force is required to release the tangs 82 from the detents 78 and to rotate stay 74 with respect to the infant car seat. Finally, the reliability of the adjustment mechanism is low due to wear and tear on the tangs 82 over time.

Therefore, the industry lacks a canopy adjustment device with a reliable, easy to use, and durable pivot locking structure. In particular, a device is needed that is simple in structure and requires a minimum of moving parts. A device that does not require locking teeth to flex would provide certain advantages in wear and tear and durability. In addition, a device that smoothly rotates between adjustable positions and does not require a separate unlocking step is not known in the industry and would provide certain advantages over existing canopy pivots. For example, a device that does not vibrate or move in a radial direction while being unlocked and rotated is needed. In addition, it would be advantageous to require as little force as possible to rotate a canopy frame about the canopy pivot while allowing the canopy pivot to lock the canopy frame in place relative to a support structure when force is not applied to the canopy frame. Finally, a device that is economic and light weight while providing the above stated advantages would provide an improvement in the field of canopy pivots.

SUMMARY OF THE INVENTION

The invention solves the above mentioned problems and avoids the drawbacks and disadvantages of the conventional art by providing a side locking pivot mechanism that is simple and economic in construction and rotates smoothly between positions requiring little force to unlock and rotate the mechanism.

In particular, the invention incorporates, for example, a canopy pivot for a child support that has a first member with indents and a second member with protrusions. The second member is rotatable with respect to the first member and is lockable and unlockable with respect to the first member due to the particular flexibility of specific portions of the first member, as discussed below.

A retainer is provided to keep the first member and second member from going beyond a predetermined distance with respect to each other. Accordingly, when the first member is rotated with respect to the second member, the portion of the first member located between the point of contact of the retainer and the indent flexes to allow the protrusion of the second member to ride over the indent, and smoothly ratchet to a new location.

In a preferred embodiment of the invention, the above principles of the pivot invention are incorporated into a canopy for a child support. In particular, the first member is built into a child support and includes a slotted opening. The second member includes a pivot pin that can be snapped into the slotted opening so that the first member rotates about the pivot pin. The second member can be attached to a canopy frame and canopy so that the canopy can be adjusted with respect to the child support.

The number of parts required for the canopy pivot invention is minimal and the manufacture of the device is simple, resulting in a device that is more economical to manufacture and easier to assemble. In addition, the invention provides a device that is easy to operate, does not require a lock/unlock step or mechanism, and rotates smoothly about a pivot pin.

DETAILED DESCRIPTION OF PREFERRED EMBODIMENTS

Reference will now be made in detail to the presently preferred embodiments of the invention, examples of which are illustrated in the accompanying drawings. The working principle of the invention can be demonstrated using two structures—a first member and a second member. Nubs are provided on the first member and corresponding indents are provided on the second member. A retaining structure is provided on one of the first and second members to retain the first member from going beyond a preset distance away from the second member (and vice-versa) while allowing rotation therebetween. The first member and second member of the pivot are automatically lockable with respect to each other due to a frictional interconnection between the nubs and indents. The amount of force required to unlock and rotate the first member with respect to the second member is dependent on the flexibility of the portion of the first or second member located between the point of contact with the retainer structure and the indent or nub. Accordingly, the flexibility of this portion is critical to the functioning of the pivot and must be designed in accordance with the specific purpose for a particular application of the pivot. The pivot provides particular advantages for a device in which it is desired to use only one hand to smoothly adjust an item in numerous positions relative to the device without a separate step of locking or unlocking the item from the device. The principles of the invention will be illustrated in the context of an infant seat canopy pivot. Of course, the pivot could also provide great advantages in positioning an item such as a toy, eating utensil, cover, or other similar item relative to a support device such as a bed, chair, wheelchair, bicycle, play pen, high chair, child support, child stroller, child car seat, baby bouncer or other similar device.

Figure 1A:
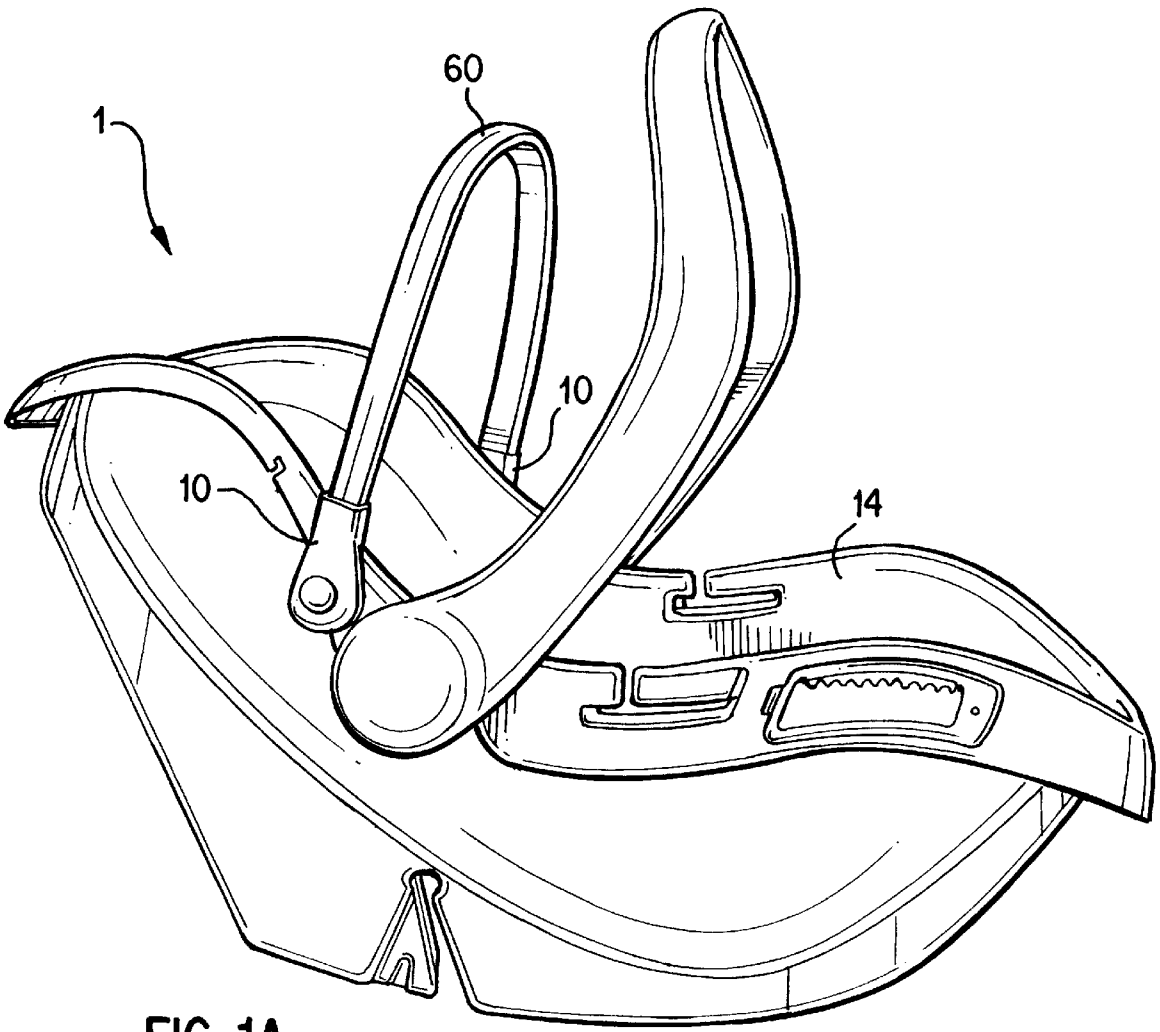
FIGS. 1A–B are perspective views of a child's seat and canopy pivot embodying the principles of the invention without and with a cloth canopy secured thereto, respectively.
Figure 1B:
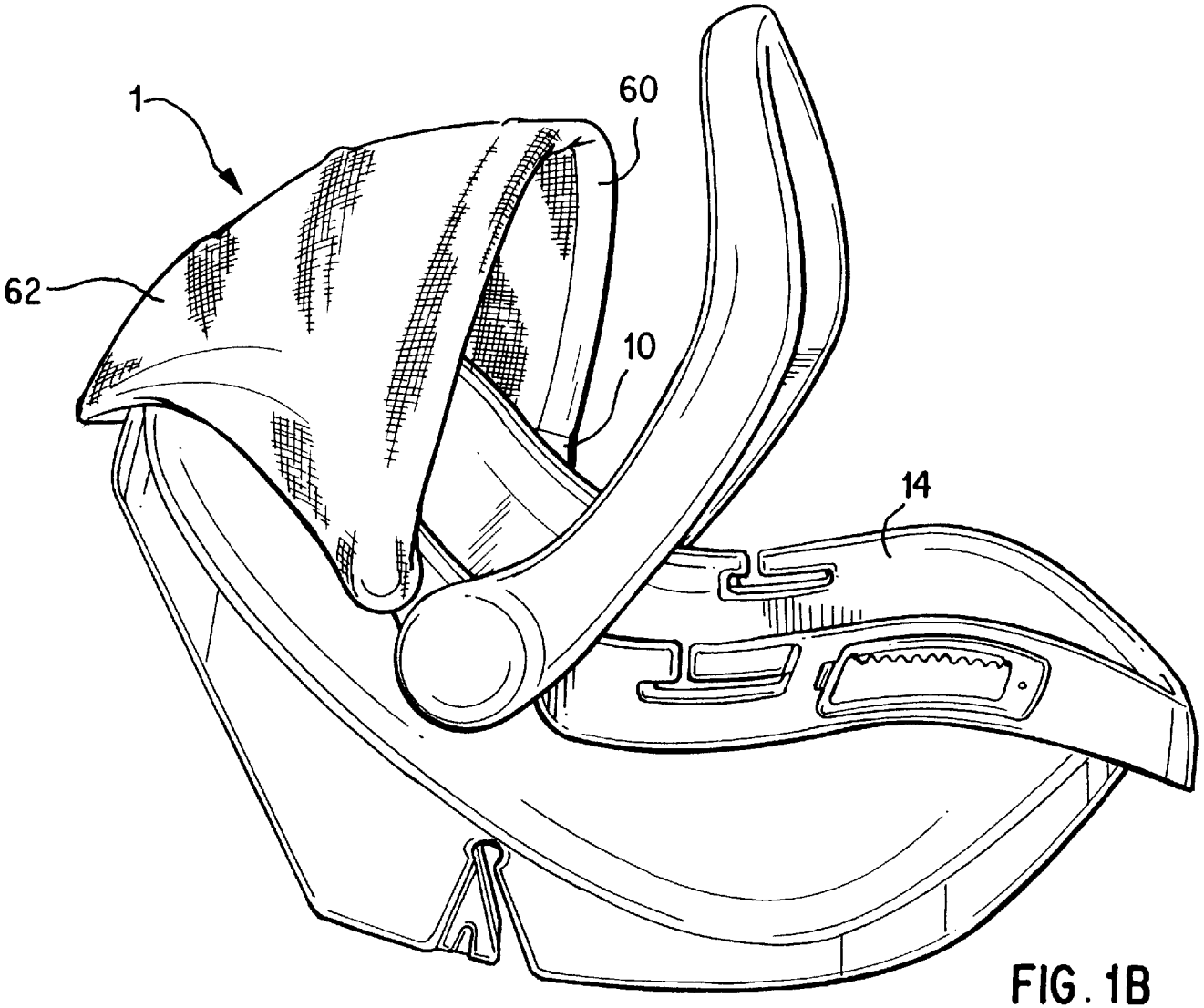
Figure 2A:
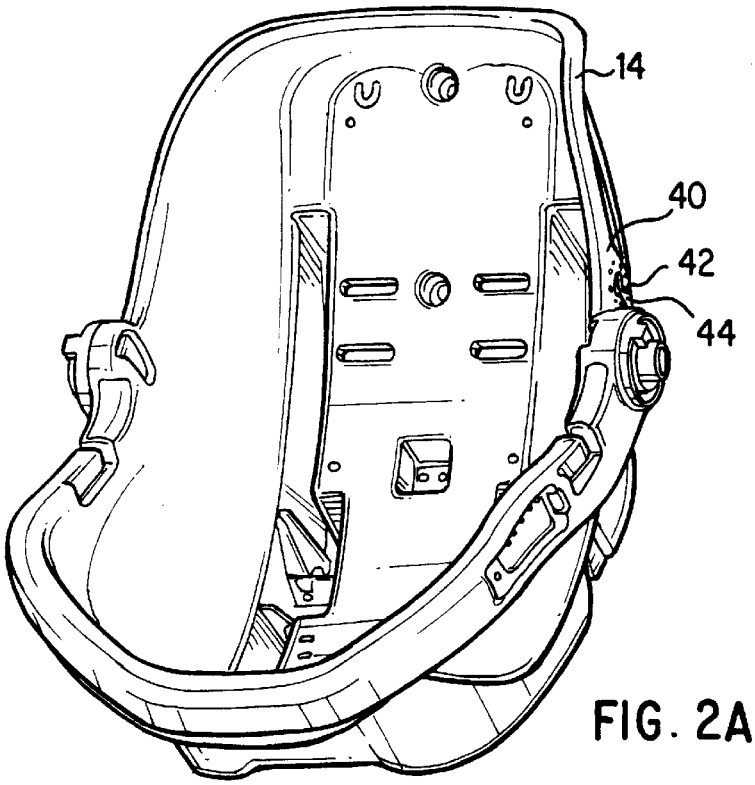
FIGS. 2A–B are perspective views of the seat shell of the child's seat shown in FIGS. 1A–B.
Figure 2B:
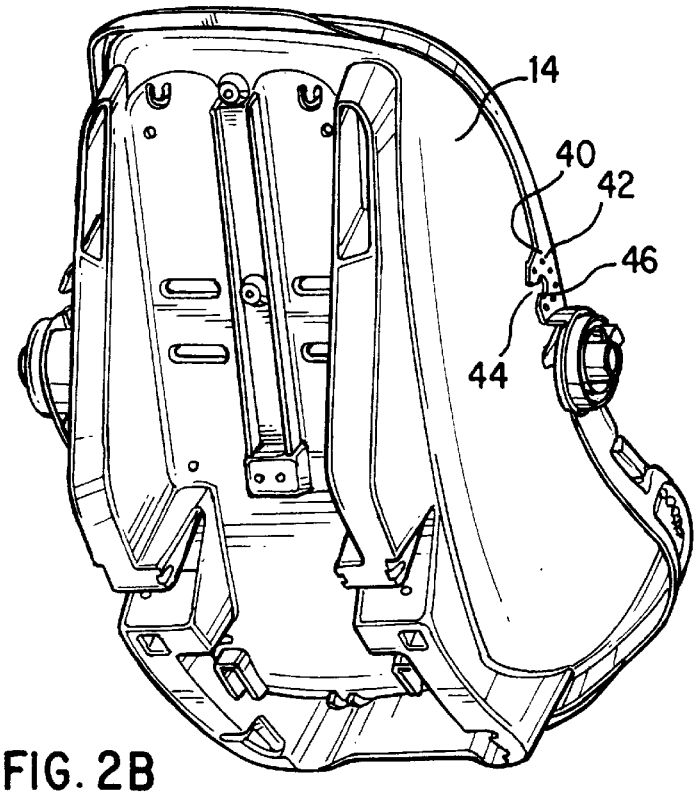

In a preferred embodiment, a child's car seat 1 including a canopy pivot is illustrated in FIGS. 1A–B. A canopy 62 attached to the canopy pivot via a canopy frame 60 is quickly and easily positioned at incremental locations above the child's car seat to protect a child from exterior elements such as wind, rain and rays of the sun.

The child's car seat 1 includes a shell 14 in which an infant can be seated and a canopy frame 60 attached to the seat shell 14 by a canopy pivot member 10. A canopy 62 is attached to the canopy frame 60 and to the back of the child's car seat 1 such that when the canopy frame 60 is rotated about the canopy pivot, the canopy 62 expands to shield a child seated in the seat shell 14. The canopy 62 is preferably made from cloth, but can be made from any type of material that will block wind, rain and/or sun rays from passing therethrough.

Figure 3B:
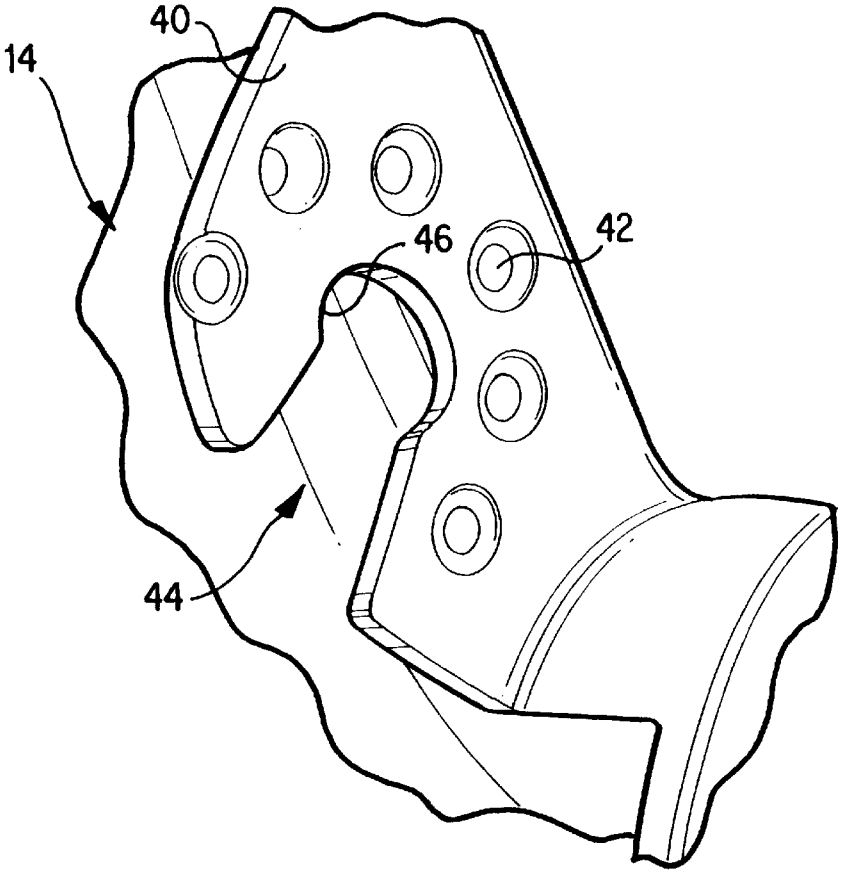
FIGS. 3A–B are perspective views of the canopy pivot attached to the flange, and the flange, respectively, of the child's seat of FIGS. 1A–B.
Figure 3A:
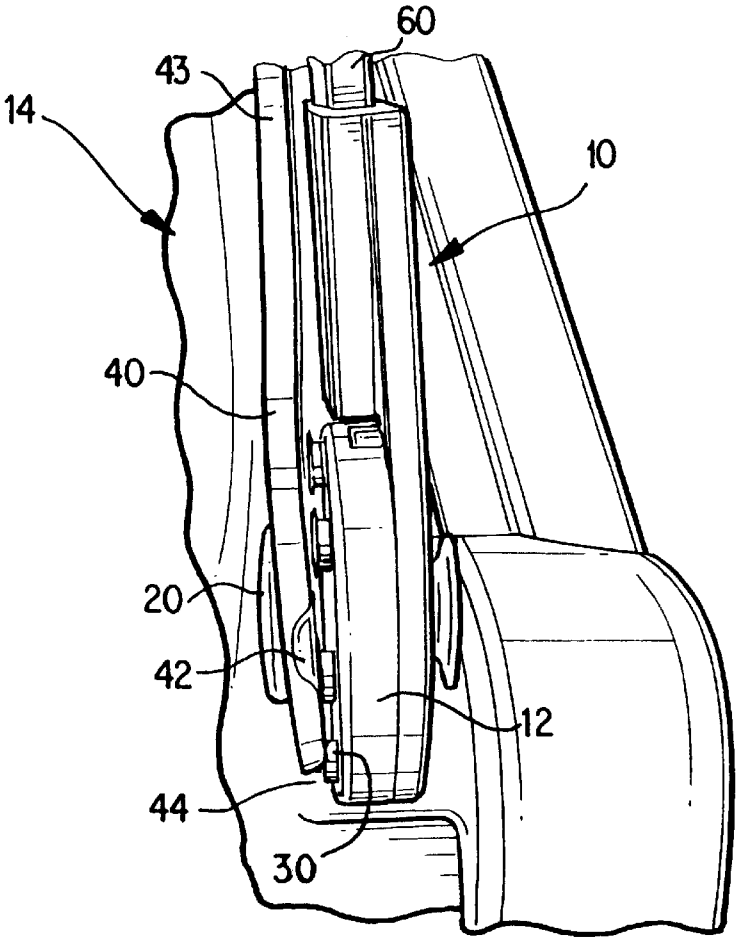
Figure 8A:
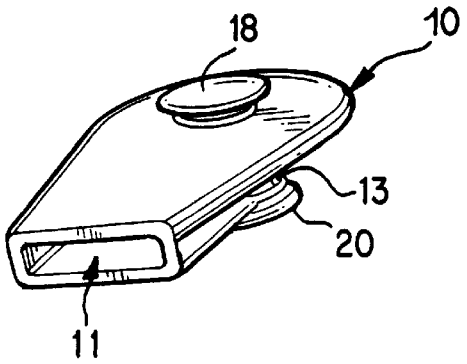
FIGS. 8A–8K are a first and second perspective view, side view, top view, bottom view, right view, left view, sectional view along line 8H—8H of FIG. 8D, sectional view along line 8I—8I of FIG. 8C, sectional view along line 8J—8J of FIG. 8D, and detailed view of detail 8K of FIG. 8H, respectively, of the canopy pivot embodying the principles of the invention.
Figure 8B:
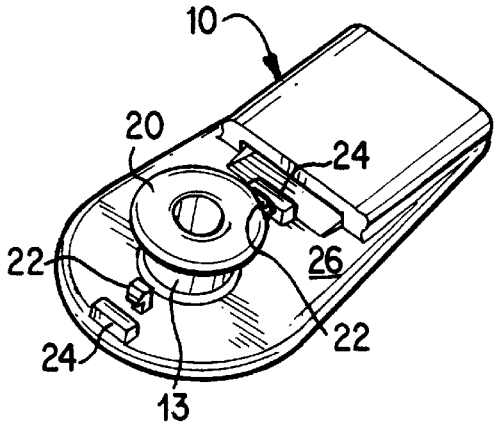
Figure 8C:
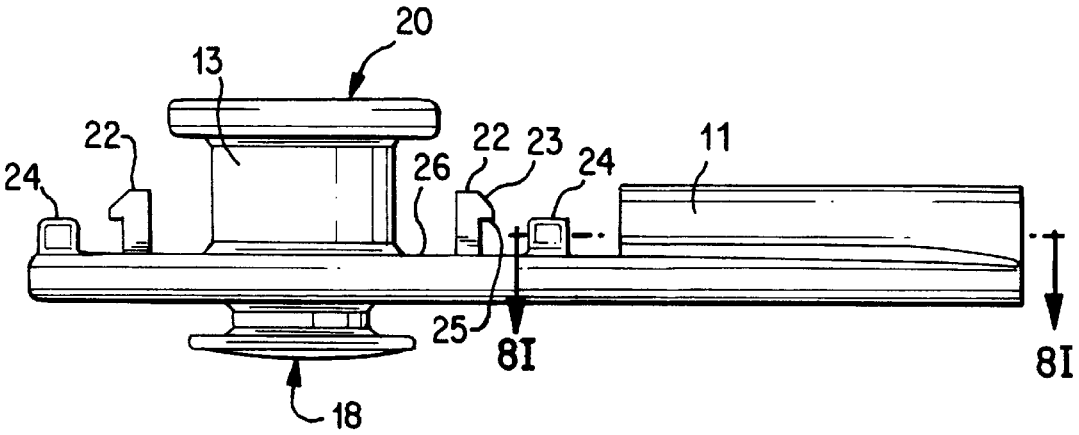
Figure 8D:
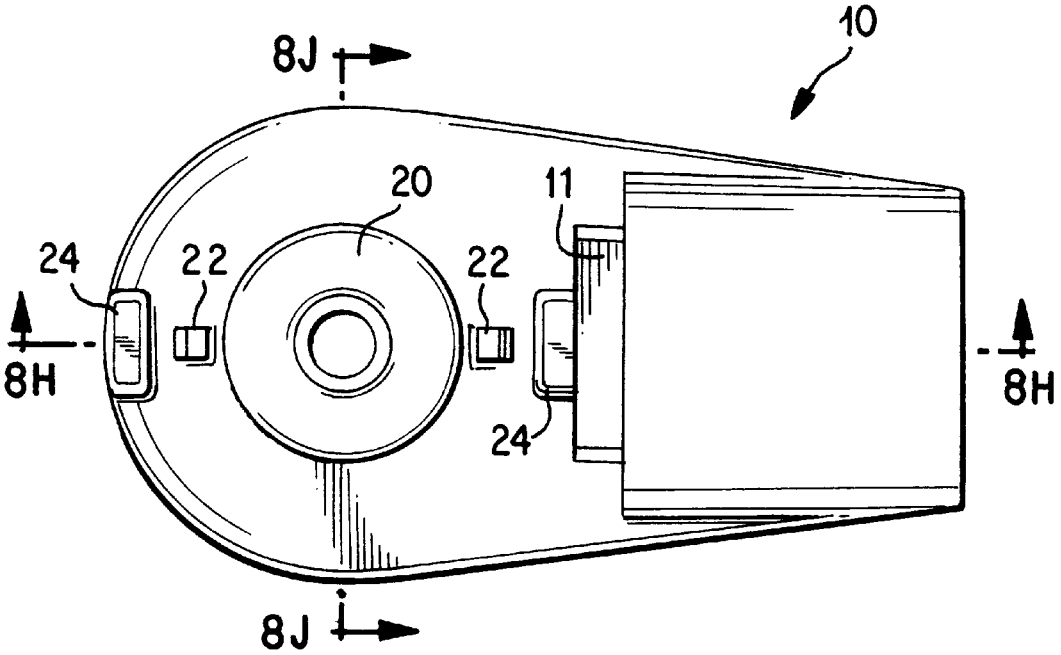
Figure 8E:
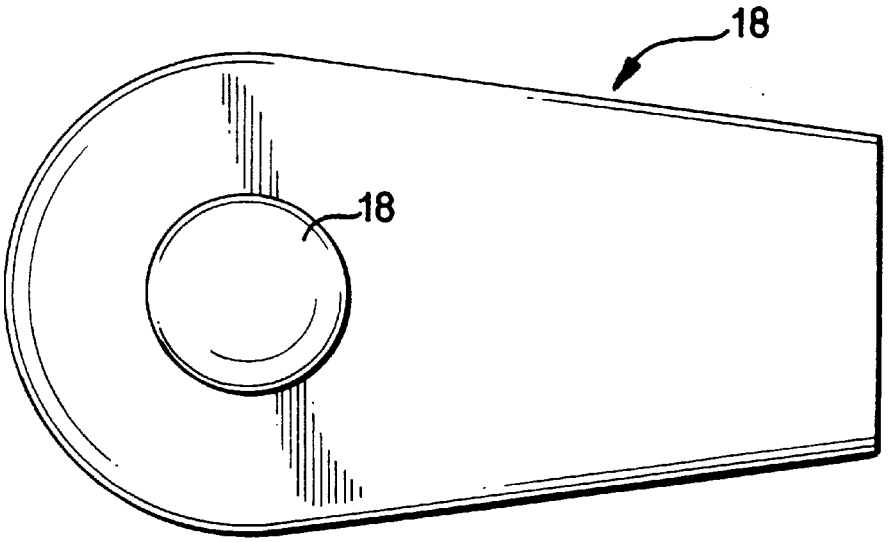
Figure 8F:
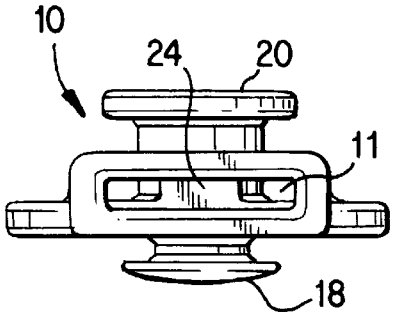
Figure 8G:
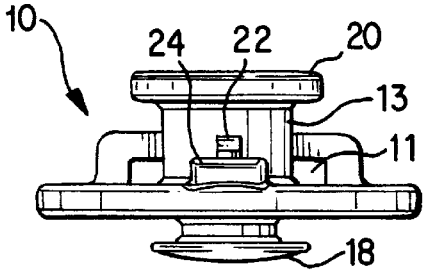
Figure 8H:
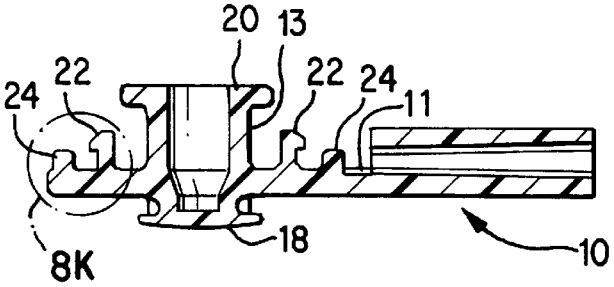
Figure 8I:
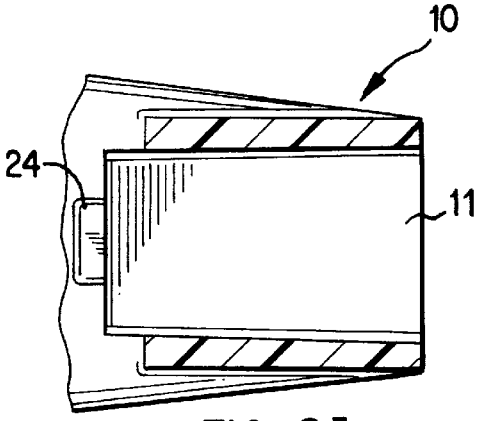
Figure 8J:
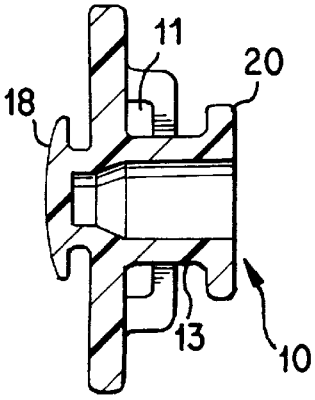
Figure 8K:
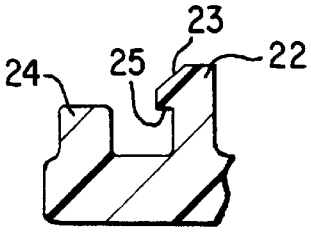

FIGS. 3A–B show the attachment structure for pivotally attaching the canopy to the child's car seat 1. As shown in FIG. 3A, a canopy pivot member 10 can be slid onto a flange 40 of the seat shell 14. A post 13 (as shown in FIGS. 8A–8C) is slid into slot 44 of the seat shell 14 until it passes neck 46 and is locked in opening 47 located in the flange 40. The neck 46 locks the canopy pivot member 10 in place while allowing it to rotate within the opening 47 in the flange 40. A retaining disc 20 (as shown in FIGS. 3A, 4A and 8A–C) retains the canopy pivot member 10 in close relationship to the flange 40 such that the lock ring 12 is frictionally engaged with the flange 40. Accordingly, the flange 40 is sandwiched between the retaining disc 20 and the lock ring 12 such that nubs 30 will lock into indents 42 located on the flange 40 to rotationally fix the canopy pivot member 10 with respect to the seat shell 14. The resiliency of the flange 40 in combination with the predetermined distance between the lock ring 12 and the retaining disc 20 provide the resilient force necessary to allow the canopy pivot member 10 to lock at a set angular position with respect to the shell 14 while allowing the canopy pivot member 10 to rotate with respect to the seat shell 14 when sufficient force is applied to the canopy frame 60.

Figure 4B:
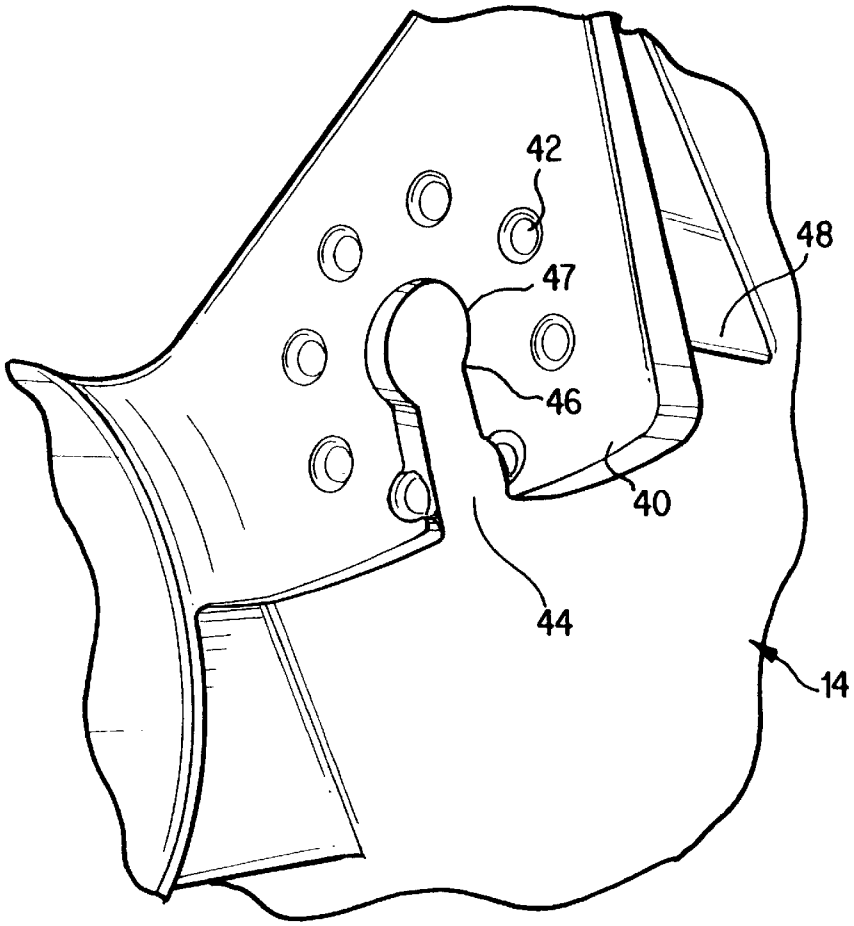
FIGS. 4A–B are perspective views of the canopy pivot attached to the flange and the flange, respectively, of the child's seat according to a preferred embodiment of the invention.
Figure 4A:
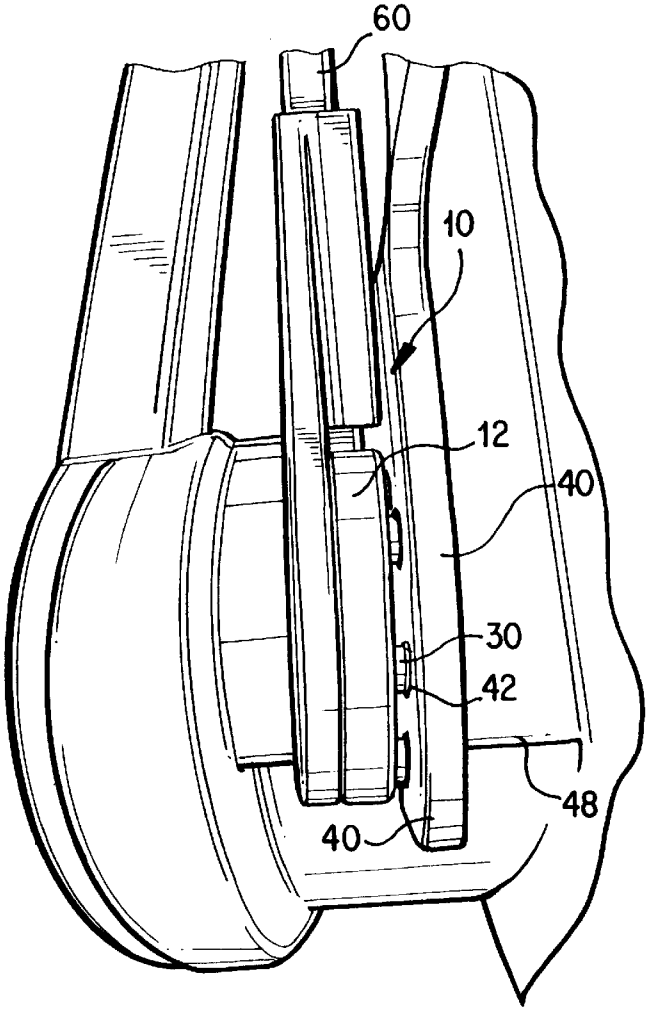

FIGS. 4A–B show a preferred embodiment of the structure by which the canopy frame 60 is pivotally connected to the seat shell 14. In the embodiment of FIGS. 4A–B, a brace 48 may be attached to the flange 40 to provide additional structural stability to the flange 40. Eight indents 42 are provided in the flange 40, as shown in FIG. 4B.

Figure 5A:
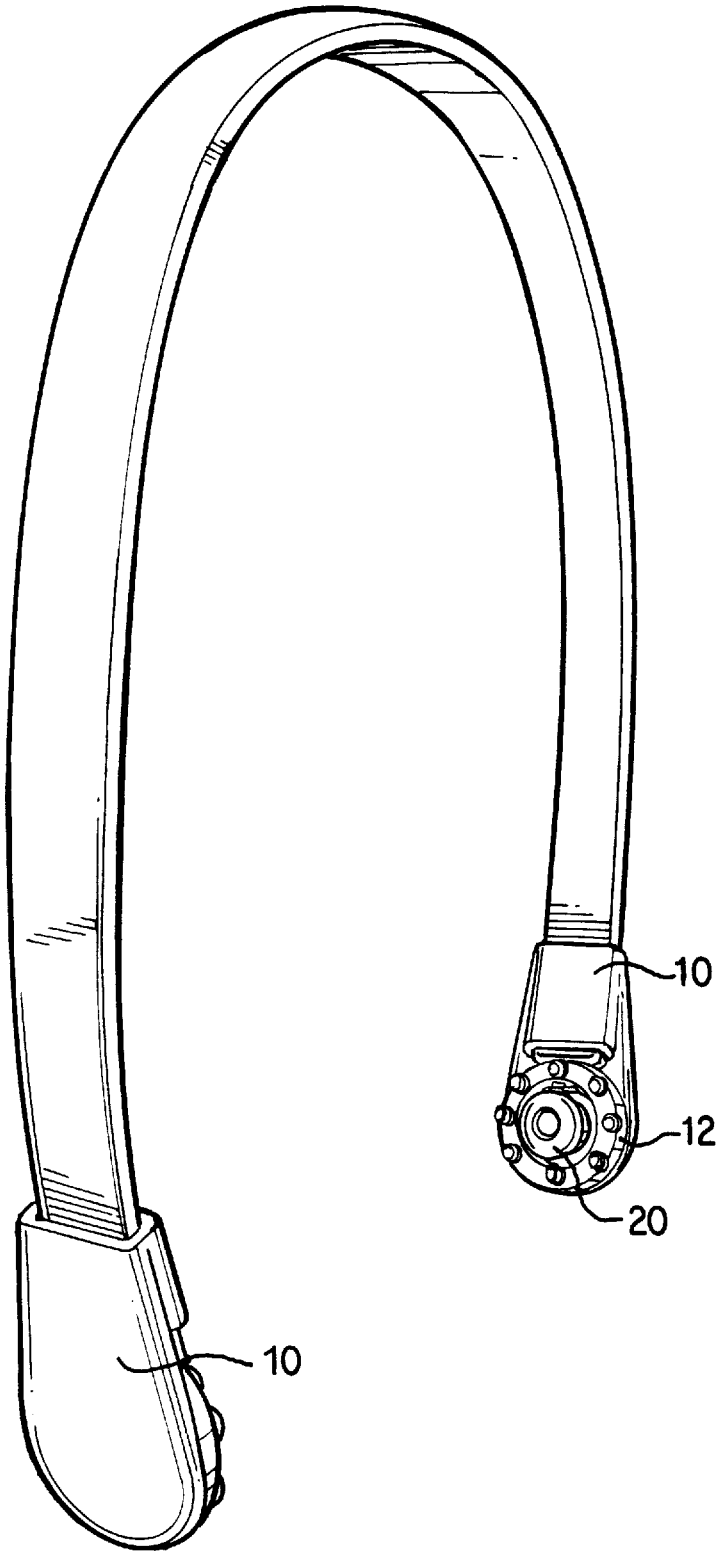
FIGS. 5A–B are perspective views of the canopy frame attached to the canopy pivot embodying the principles of the invention in a preferred embodiment and another embodiment, respectively.
Figure 5B:
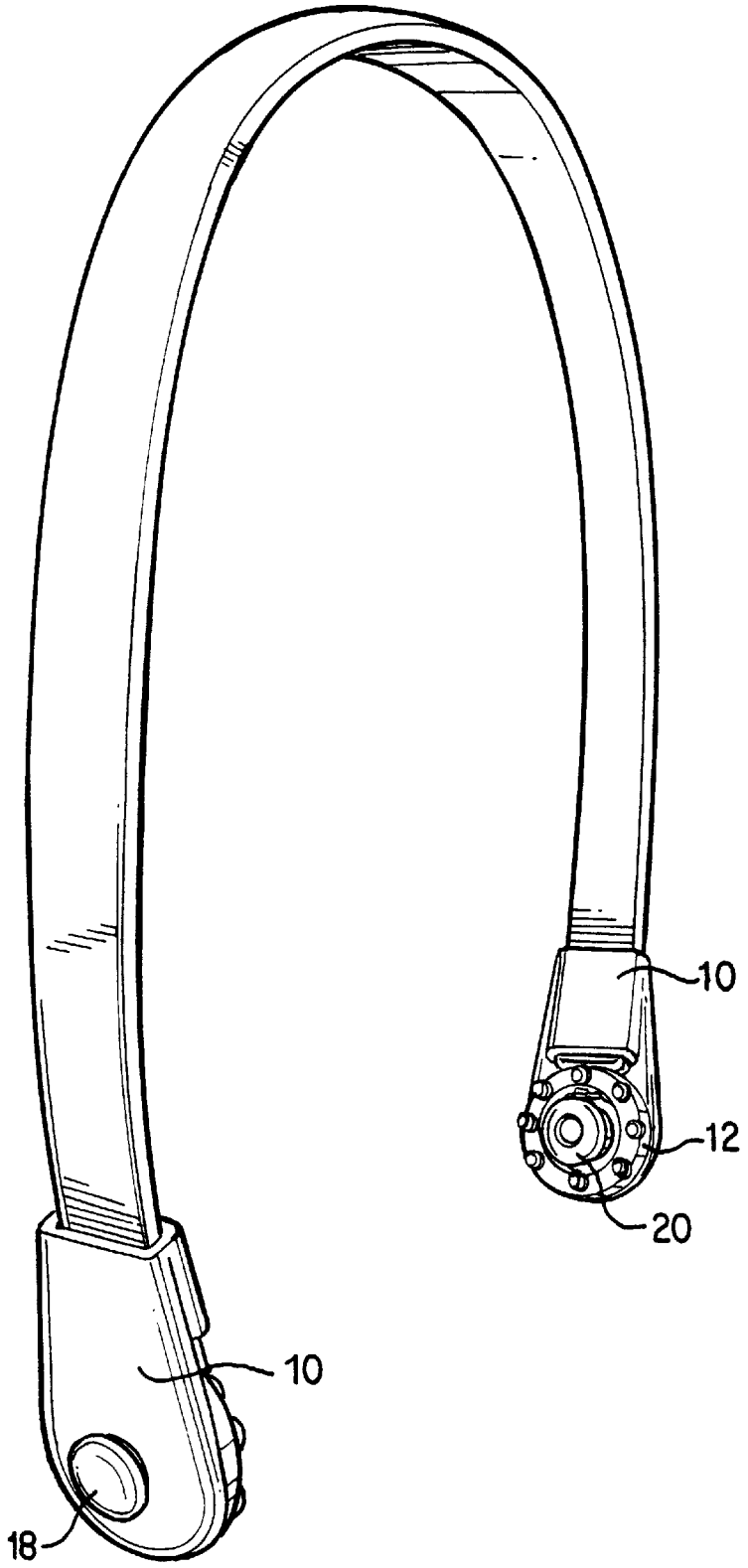

As shown in FIG. 5A, the frame member 60 is attached to two canopy pivots 10 located at either end of the frame 60 for attachment to both sides of the child's car seat 1. FIG. 5B shows an alternative embodiment in which the canopy pivot member 10 includes a button 18 to which an elastic loop can be attached to secure the canopy to the canopy pivot member 10.

As shown in FIGS. 6–8K, the canopy pivot member 10 has an inner surface 26 that carries a lock ring 12. The lock ring 12 can be attached to the inner surface 26 by a pair of ribs 24 that work in connection with a pair of fingers 22 to brace and clip the lock ring 12 in place on the canopy pivot member 10. The ribs 24 and fingers 22 work in pairs, each pair located a predetermined distance from the center of the post 13 and along a diametrical line running through the post 13. As can be seen in FIG. 8C, the rib 24 located closest to the channel 11 also provides a stop for the canopy frame when it is slid into the channel 11. When the lock ring 12 is attached to the canopy pivot member 10, each rib 24 provides a pivot point for sliding the lock ring onto the inner surface 26 of the pivot member 10. Fingers 22 have an angled surface 23 so that the lock ring 12 can be easily slid between each of the fingers and its respective rib 24. A latch surface 25 is located beneath the angled surface and latches onto the lock ring 12 once the lock ring is settled onto the inner surface 26 of the canopy pivot member 10. The specific construction of the lock ring 12 and canopy pivot member 10 described above facilitates manufacture of the devices because each of the devices can be formed in a split mold and less material is required. However, the lock ring 12 and canopy pivot 10 could be formed integrally, albeit with a more complicated molding process, to facilitate assembly of the device.

Regardless of the lock ring 12 and canopy pivot 10 construction, post 13 spaces the retaining disc 20 away from the inner surface 26 and the lock ring 12 such that the flange 40 can be frictionally fit between the retaining disc 20 and the lock ring 12 to produce a predetermined amount of friction between the retaining disc 20, lock ring 12 and the flange 40.

Figure 7:
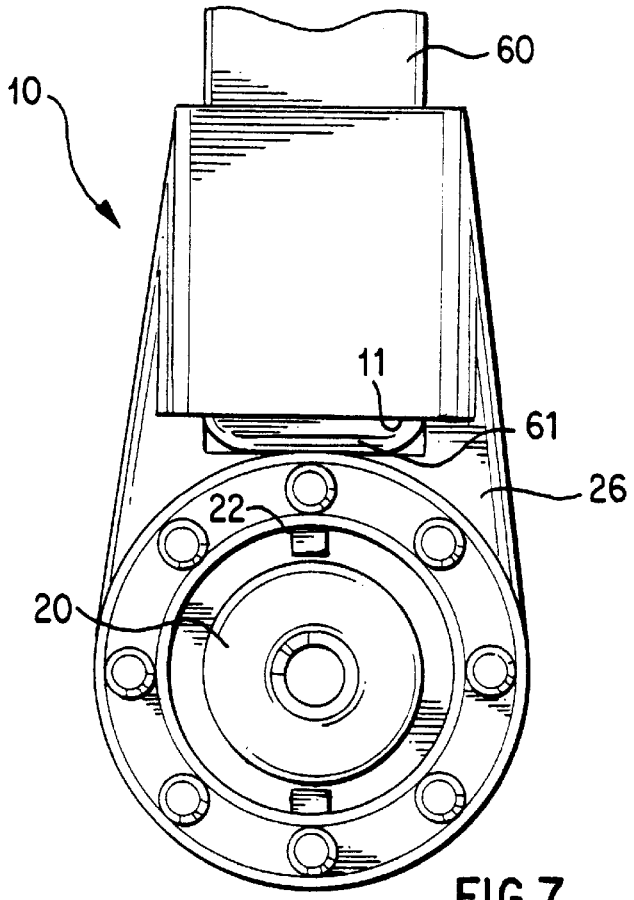
FIGS. 6–7 are perspective and top views of the canopy pivot attached to the lock ring and canopy frame of the child's seat of FIGS. 1A–B.
Figure 6:
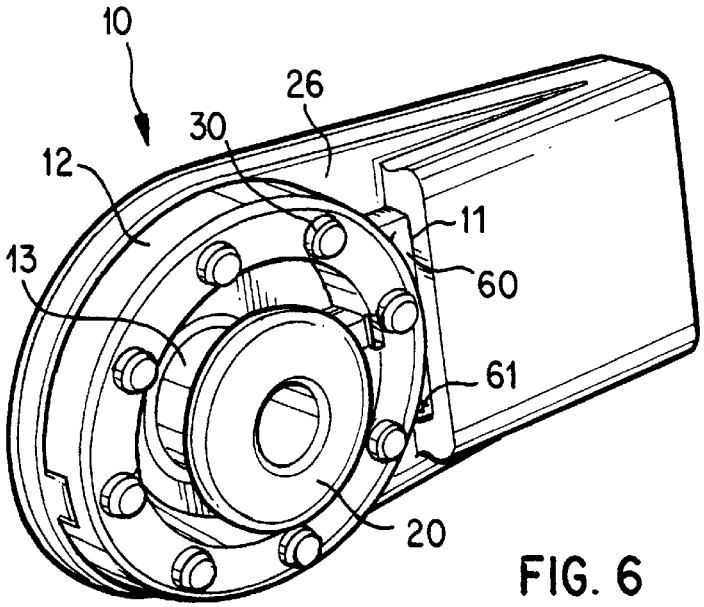
Figure 9A:
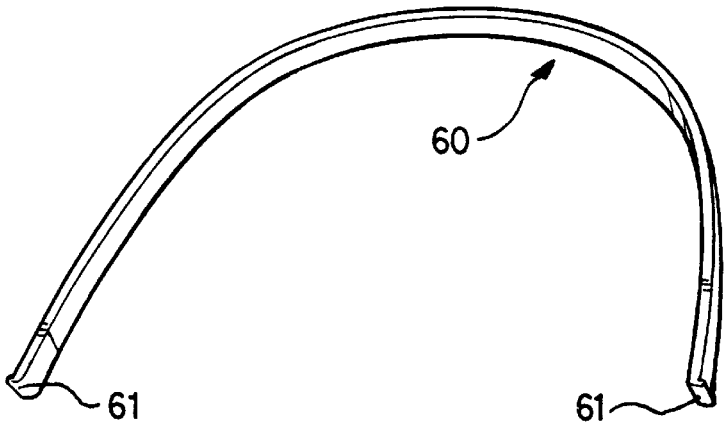
FIGS. 9A–C are a perspective view, a front view, and a detailed view of detail 9C of FIG. 9B, respectively, of the canopy frame embodying the principles of the invention.
Figure 9B:
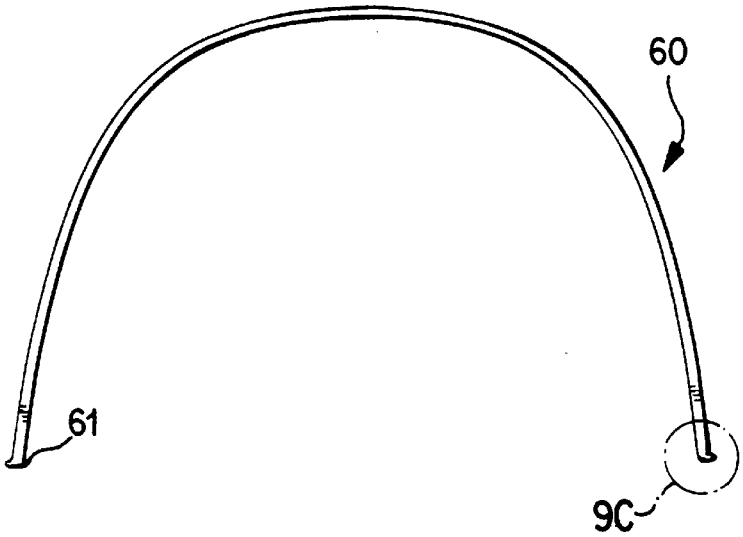
Figure 9C:
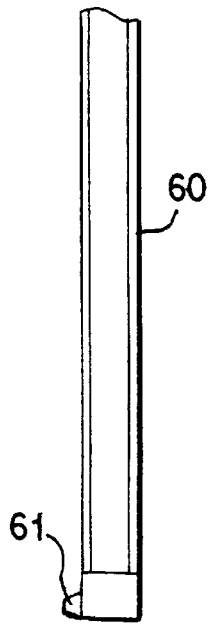

As shown in FIGS. 9A–C, the canopy frame 60 can include a resilient U-shaped band that has a frame lock 61 located at either end of the band. Preferably, the frame lock 61 comprises a nodule or bump that frictionally locks the canopy frame in the channel 11 of the canopy pivot member 10. As best seen in FIG. 7, the frame lock 61 is retained against a lip of the channel 11 to prevent the canopy frame 60 from being accidentally withdrawn from the canopy pivot member 10. However, the frame lock 61 is not so large that it permanently prevents the canopy frame 60 from being withdrawn from the canopy pivot channel 11. Specifically, the frame lock 61 should be of such a size as to allow the canopy frame 60 to be inserted into the channel 11 by flexing a lip of the channel 11 during insertion. Once inserted, the lip of the channel 11 springs back into place and prevents the canopy frame from accidentally exiting or withdrawing from the channel 11. The canopy frame 60 can be removed from the channel 11 by pulling on the canopy frame 60 to cause the lip of the channel 11 to flex and permit the frame lock 61 to be withdrawn through the channel 11.

As shown in FIGS. 10A–I, lock ring 12 is preferably annular (but may be semi-annular or arc shaped) and has a plurality of nubs or protrusions 30 on an outer surface 31 thereof. A pair of opposing lips 32 are located diametrically opposite on the inner circumference of the outer surface 31 of the lock ring 12. The opposing lips 32 provide a surface for the fingers 22 of the canopy pivot member 10 to lock onto and retain the lock ring 12 on the inner surface 26 of the canopy pivot member 10.

Finger ramps 36 are provided at diametrically opposite locations immediately adjacent the opposing lips 32 and on the inner surface 33 of the lock ring 12. The finger ramps 36 facilitate the entrance of the fingers onto the opposing lips 32. Specifically, the finger ramps 36 act as camming surfaces to gradually flex the fingers 22 as the angled surfaces 23 of the fingers 22 ride along the finger ramps 36 until the lock ring 12 seats on the inner surface 26 of the canopy pivot member 10 and the latch surfaces 25 mate with the opposing lips 32.

A pair of openings 34 are located at diametrically opposite positions on the outer circumference of the inner surface 33 of the lock ring 12. Openings 34 mate with the ribs 24 of the canopy pivot member to guide the lock ring into position and brace the lock ring 12 such that fingers 22 can ride up the finger ramps 36 and lock onto the opposing lips 32.

Figure 10A:
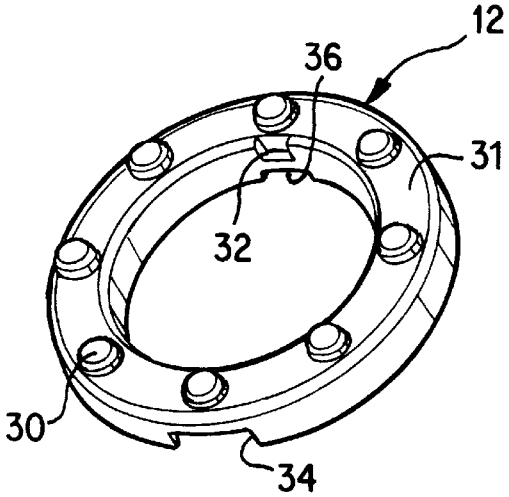
FIGS. 10A–I are a first and second perspective view, a top view, a front view, a bottom view, a left view, a sectional view along line 10G—10G of FIG. 10C, a sectional view along line 10H—10H of FIG. 10C, and a detailed view of detail 101 of FIG. 10G, respectively, of the lock ring of the pivot member of FIGS. 6 and 7.
Figure 10B:
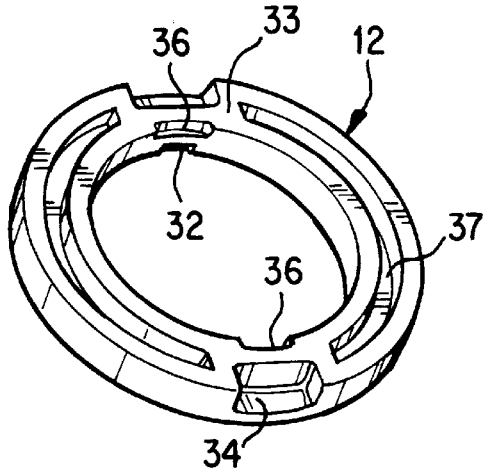
Figure 10C:
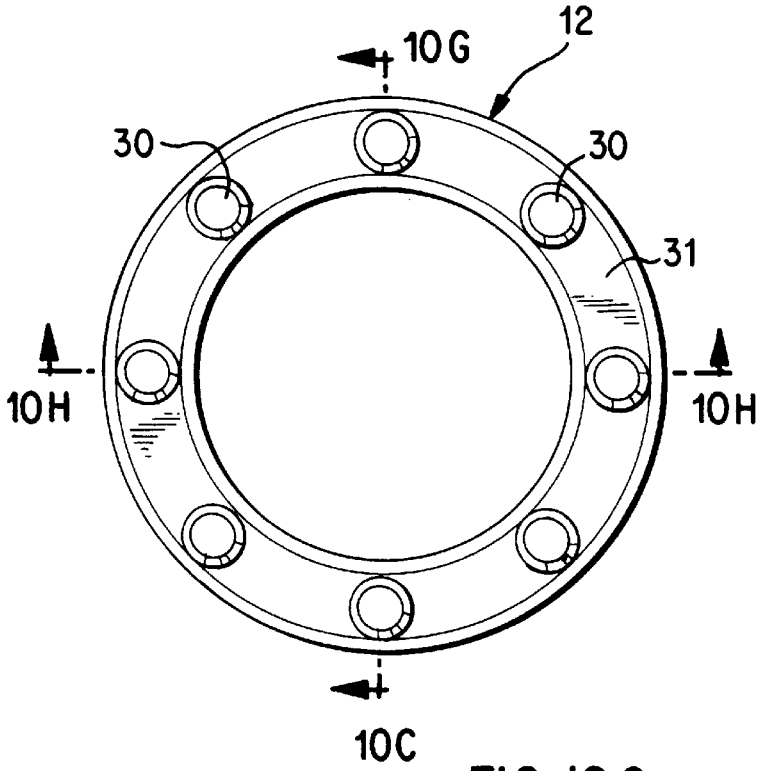
Figure 10D:
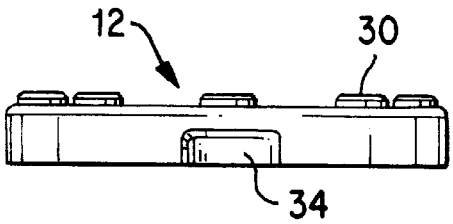
Figure 10E:
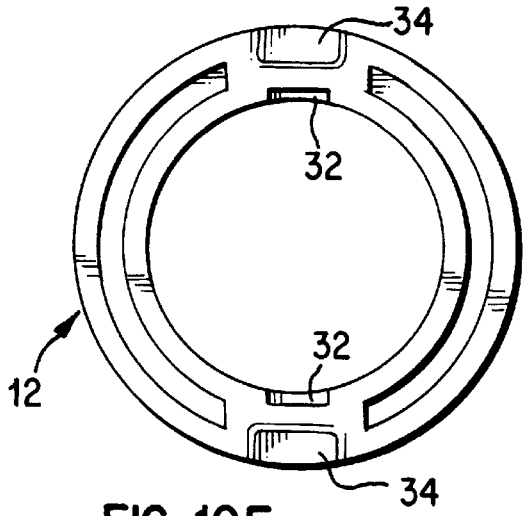
Figure 10F:
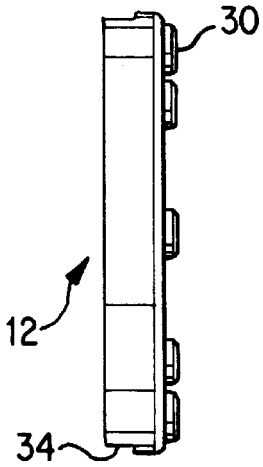
Figure 10G:
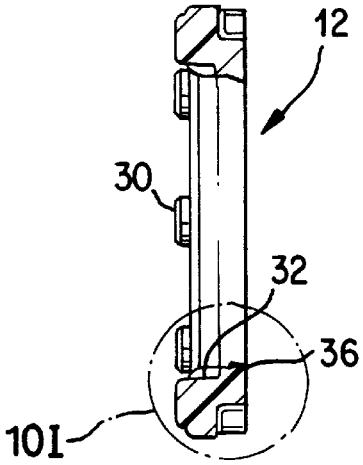
Figure 10H:
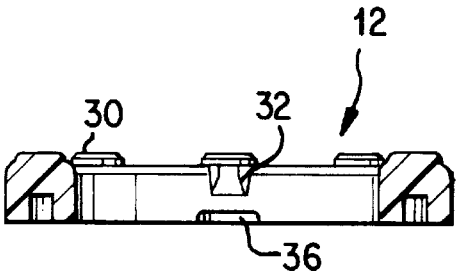
Figure 10I:
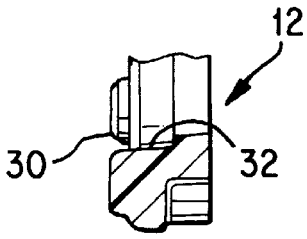

Channels 37 can be placed in the inner surface 33 of the lock ring 12 to reduce the amount of material while retaining strength. The nubs 30, as shown in FIGS. 10C and 10I, are preferably cylindrical protrusions that extend a short distance from the outer surface 31 of the lock ring. However, the nubs 30 can be configured in many other shapes provided that the shape cooperates with the corresponding indent and provides enough frictional engagement to fix the canopy pivot member 10 in a rotational position with respect to the flange 40. Furthermore, the nubs 30 could be placed on the flange 40 and indents be placed on the outer surface 31 of the lock ring 12.

In operation, the canopy 62 is drawn over the seat shell 14 by simply pulling on the canopy frame 60 to cause the canopy frame 60 to rotate about the canopy pivot. The canopy pivot is configured such that a typical pull on the canopy frame 60 by a person will unlock the canopy pivot and allow the canopy frame 60 and the canopy 62 to be rotated about the canopy pivot. Furthermore, the canopy pivot is configured such that when a person ceases pulling on the canopy frame 60, the canopy pivot will lock at a predetermined incremental location to secure the canopy 62 at a desired position over the child's seat shell 14. No secondary actions need to be performed to unlock the canopy pivot and rotate the canopy 62 over the seat shell 14. Moreover, there are no separate locking mechanisms that must be unlocked or maneuvered before rotating the canopy 62, and no separate locking mechanisms that must locked to set the canopy 62 at a position over the car seat shell 14. The invention provides a simple structure for adjusting the position of a canopy 62 over a support structure.

Manufacture and assembly of the invention is simplified due to the small number of parts and their designed interaction with each other. In particular, attachment of the canopy pivot member 10 and the canopy frame 60 to the seat shell 14 is accomplished by snapping the post 13 into a corresponding slot 44 in the seat shell 14 until the neck 46 locks the post 13 into the circular openings 47 in the flange 40. Thus, the canopy pivot 10 is secured to the seat shell 14 and is able to rotate about the post 13.

Figure 11A:
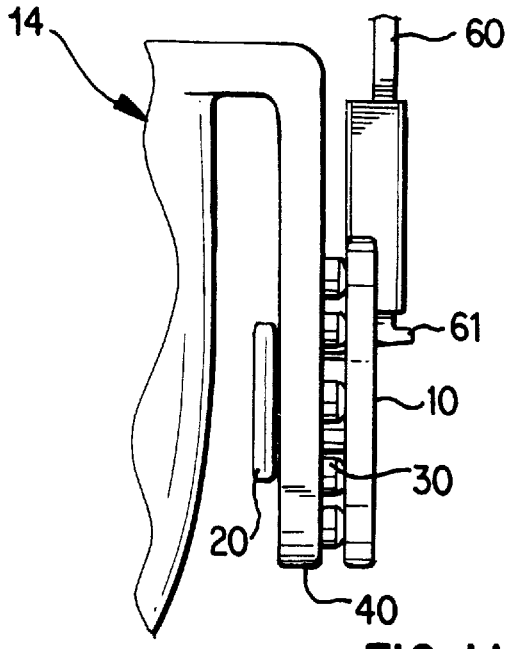
FIGS. 11A–B are a side elevation view of the pivot and a bottom view of the pivot member, respectively, embodying the principles of the invention according to a further embodiment.
Figure 11B:
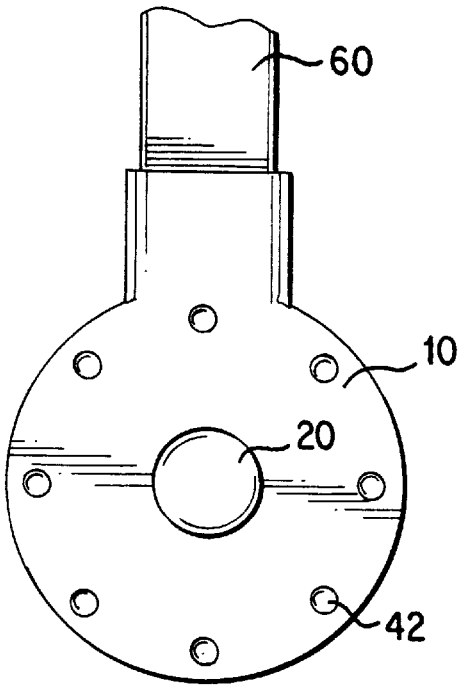

FIGS. 11A–B show an alternate embodiment of the invention in which nubs 30 are provided on the flange member 40 extending from the child seat 14. In this embodiment, canopy pivot member 10 includes indents 42 which mate with the nubs 30 of the flange member 40.

Figure 12B:
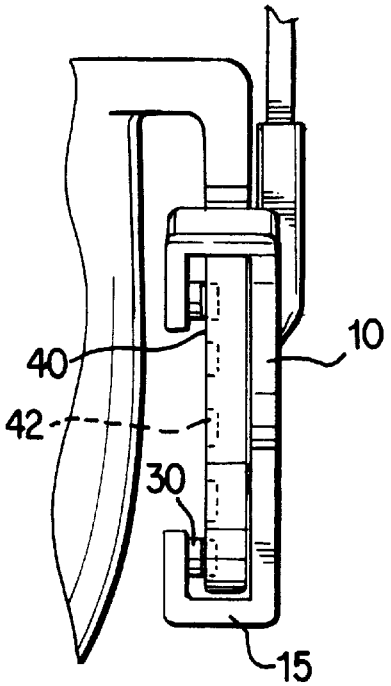
FIGS. 12A–B are front perspective and side elevation views of a pivot embodying the principles of the invention according to a further embodiment.
Figure 12A:
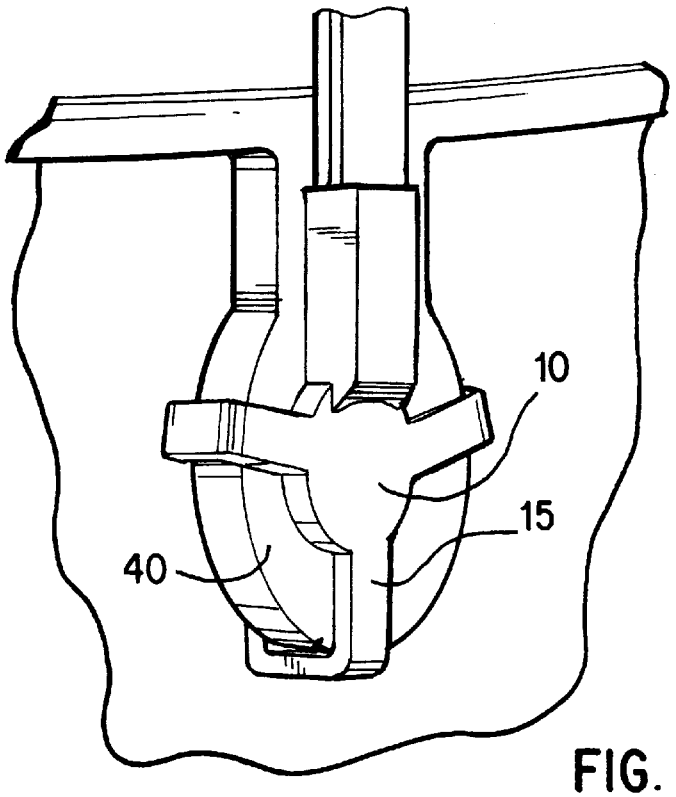

FIGS. 12A–B show yet another embodiment of the invention in which the canopy pivot member 10 includes several retainer arms 15 that connect the canopy pivot member 10 to the flange 40. Protrusions 30 may be provided on the retainer arms 15 to mate and lock with indents 42 located on the flange member. In the alternative, retainer arms 15 can be provided with indents 42 and the flange member 40 can be provided with nubs 30. In either case, the retainer arms retain the canopy pivot member 10 from going beyond a set distance from the flange member 40 such that the nubs and protrusions will lock together at sequential positions and be unlockable when the canopy frame 60 is rotated by a user about the canopy pivot.

Although the invention has been described with reference to a canopy pivot for a child's car seat, it is not beyond the scope of the invention to incorporate the canopy pivot into other devices such as baby strollers, cribs or furniture made for adults. Furthermore, the pivot of the invention can conceivably be incorporated into structures other than support devices.

The canopy pivot and canopy frame are preferably made from a plastic material, but can be made from any other suitable material that is flexible and easily molded or shaped. In particular, the material chosen for the seat shell is preferably plastic, but may be any material that will provide the suitable flexibility for the flange member 40 such that it will resiliently lock with the lock canopy pivot member 10 as described above. Of course, the flange member 40 need not be formed integrally with the seat shell, but could be formed separately, and of different material.

The canopy frame 60 is shown as being a U-shaped strip of material, but may be configured in other shapes to provide different canopy designs. For example, the frame member 60 may be V-shaped, square shaped, or include a plurality of bends. As discussed above, the canopy 62 is preferably made of cloth but may be made of any material that will prevent sunlight, rain or wind from entering into the seat shell 14. Other suitable materials for the canopy 62 may be plastics, light weight metals, screening, or other suitable materials.

The canopy pivot and canopy frame disclosed herein are incorporated into the upper surface of a seat shell 14. However, it is contemplated that the canopy pivot and canopy frame 60 can be placed at different locations on the seat shell 14 depending on desired use for the canopy 62. For example, a canopy 62 can be placed at the lower portion of the seat shell to protect an infant's legs from wind and rain and can be used in combination with a canopy placed on the upper portion to completely isolate a child from adverse elements.

What is claimed is:

1. A pivot for adjusting the orientation of a first structure with respect to a second structure, the pivot comprising:

a first member having a flexible flange extending in a first plane and a first locking structure located on said flexible flange;

a second member having a mating flange extending in a second plane and a second locking structure configured to cooperate with said first locking structure, wherein said first and second planes extend generally parallel to each other; and a pivot pin integrally formed and extending from one of said first member and said second member, said pivot pin including a retainer cooperating with the other of said first member and said second member to prevent the first member from moving more than a predetermined distance away from the second member while permitting the first member to rotate with respect to the second member; wherein when the first member is rotated relative to the second member, a portion of the flexible flange located between said first locking structure and a point of contact with said retainer is caused to flex and allow the second locking structure to release from the first locking structure.

2. The pivot of claim 1, wherein the first member is a support structure for a child.

3. The pivot of claim 1, wherein the first member is a canopy frame for a child support structure.

4. The pivot of claim 1, wherein the second member is a support structure for a child.

5. The pivot of claim 1, wherein the second member is a canopy frame for a child support structure.

6. The pivot of claim 1 wherein said first locking structure comprises one of an indent and a protrusion, and said second locking structure comprises the other of a protrusion and an indent, respectively.

7. The pivot of claim 1, wherein said retainer comprises a disc extending from said pivot pin to prevent one of said first and second members from disengaging from said pivot pin.

8. The pivot of claim 1, further comprising:

a plurality of retainer arms extending from said retainer and partially encasing one of said flexible flange and said mating flange to prevent the first member from moving more than a predetermined distance away from the second member while permitting the first member to rotate with respect to the second member.

9. A pivot for adjusting the orientation of a first structure with respect to a second structure, the pivot comprising:

a first member having an opening and a first flange portion extending in a first plane;

a second member having a second flange portion extending in a second plane that is generally parallel to said first plane, said second member including a pivot pin integrally extending from said second member and disposed in said opening in said first member for rotation therein;

an indent located on one of said first flange portion and said second flange portion;

a protrusion located on the other of said first flange portion and said second flange portion, said protrusion disposed for operative interaction with said indent;

a retainer integrally disposed on one of said first member and said second member, said retainer engaging the other one of said first member and said second member to retain said pivot pin in said opening and to limit axial displacement of said pivot pin out of said opening such that when the first member is rotated with respect to the second member a portion of the first member located between a) one of said indent and said protrusion, and b) a location of engagement of the retainer flexes to allow said protrusion to release from said indent.

10. The pivot of claim 9, wherein the first member is a support structure for a child.

11. The pivot of claim 9, wherein the first member is a canopy frame for a child support structure.

12. The pivot of claim 9, wherein the second member is a support structure for a child.

13. The pivot of claim 9, wherein the second member is a canopy frame for a child support structure.

14. The pivot of claim 9, further comprising:

a plurality of indents located on one of said first member and said second member.

15. A child support structure including a pivoted canopy, the child support comprising:

a support shell including a child support portion and having a flexible flange portion extending in a first plane with a locking element located on said flexible flange portion;

a canopy structure located on the support shell;

a canopy pivot member located on the canopy structure and pivotally attached to the support shell, said canopy pivot member including a pivot pin with a retainer extending outward from the pivot pin at a first end and an integral second flange portion extending in a second plane from a second end of said pivot pin, said second plane being generally parallel to said first plane; and means provided on the canopy pivot member and support shell for automatically unlocking the canopy pivot member and allowing the canopy to rotate about an arcuate radial path about a pivot point located on the support shell when a user moves the canopy about the pivot point, and for automatically locking the canopy with the respect to the support shell when the user stops moving the canopy about the pivot point.

16. The child support of claim 15, further comprising:

a channel formed as a cut-out extending from an edge portion of the support shell is configured to receive the pivot pin.

17. The child support structure of claim 15, further comprising:

a lock arc formed as a separate ring shaped structure with locking elements said lock arc being attached to the canopy pivot; and attachment members located on the canopy pivot for attaching the lock arc to the canopy pivot.

18. The child support of claim 17 wherein the lock arc is disposed at a predetermined and constant distance about the pivot pin.

19. The child support of claim 15, wherein the means for automatically unlocking the canopy pivot member includes a flexible flange located on the support shell.

20. The child support of claim 19, wherein the locking structures include at least one of protrusions or extensions.

21. The child support of claim 15, wherein the support shell includes a flange with a slot located therein and the pivot pin is located within the slot in the flange.

22. The child support of claim wherein the slot is tapered and terminates at an opening that has a larger diameter than the width of the slot at a point immediately adjacent the opening such that the pivot pin is frictionally locked into the opening in the support shell.

23. The child support of claim 15, wherein the support shell is formed as a child's car seat.

24. A method for positioning a structure with respect to a child support, the method comprising:

providing a frame extending from a pivot member located on the child support, the pivot member including a first flange member extending in a first plane and a second flange member extending in a second plane that is generally parallel to said first plane, a locking structure located on said first and second flange members, and a pivot pin integral with one of said first and second flange members for retaining said frame on said child support;

automatically unlocking the pivot member by grasping a portion of the frame and rotating the frame about the pivot member, the rotation taking place at a constant distance from a center of the pivot member and causing one of said first flange member and said second flange member located on the child support to move in a direction perpendicular to a radial direction of the pivot relative to the pivot member and unlock from said locking structure; and automatically locking the pivot member with respect to the child support by releasing the portion of the frame.

25. The method of moving a structure with respect to a child support of claim 24, wherein the step of automatically locking rotation of the pivot member includes causing a plurality of locking structures located on the pivot member to mate with a plurality of locking structures located on the child support.

26. The method of moving a structure with respect to a child support of claim 24, wherein the step of automatically unlocking the pivot member includes causing one of said first flange member and said second flange member located on the child support to flex relative to the pivot member and unlock from said pivot locking structure located on the pivot member.

27. The method of moving a structure with respect to a child support of claim 26, wherein the flange is caused to move in a direction perpendicular to a radial direction of the pivot member.

28. A child support structure including a pivoted canopy, the child support structure comprising:

a support shell;

a canopy structure located on the support shell;

a canopy pivot member located on the canopy structure and pivotally attached to the support shell, thus defining a canopy pivot point;

means provided on the canopy pivot member and support shell for automatically unlocking the canopy pivot member and allowing the canopy to rotate about an arcuate radial path about a pivot point located on the support shell when a user moves the canopy about the canopy pivot point, and for automatically locking the canopy with respect to the support shell when the user stops moving the canopy about the canopy pivot point;

said support shell includes a flange with a slot located therein and the canopy pivot member includes a pivot pin located within the slot in the flange; wherein the slot is tapered and terminates at an opening that has a larger diameter than the width of the slot at a point immediately adjacent the opening such that the pivot pin is frictionally locked into the opening in the support shell.

* * * * *

UNITED STATES PATENT AND TRADEMARK OFFICE

CERTIFICATE OF CORRECTION

PATENT NO. : 6,170,910 B1
DATED : January 9, 2001
INVENTOR(S) : David M. Bapst

It is certified that error appears in the above-identified patent and that said Letters Patent is hereby corrected as shown below:

Column 3,
Line 62: "detail 101" should be -- detail 10I--

Claim 22,
Line 1: "claim" should be -- claim 21 --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*